United States Patent [19]

Herzfeld

[11] 4,246,735

[45] Jan. 27, 1981

[54] JOINTING CONSTRUCTION

[75] Inventor: Michael O. H. Herzfeld, Osborne Park, Australia

[73] Assignee: Producer Manufacturers Pty. Ltd., Osborne Park, Australia

[21] Appl. No.: 967,353

[22] Filed: Dec. 7, 1978

[30] Foreign Application Priority Data

Dec. 7, 1977 [AU] Australia ..... PD2697

[51] Int. Cl.[3] ..... E04D 3/36

[52] U.S. Cl. ..... 52/465; 52/584; 52/809

[58] Field of Search ..... 52/465, 467, 395, 584, 52/806, 809

[56] References Cited

U.S. PATENT DOCUMENTS

| | | | |
|---|---|---|---|
| 1,959,766 | 5/1934 | Sayler | 52/465 X |
| 2,045,055 | 6/1936 | Schädler | 52/467 |
| 3,423,896 | 1/1969 | Widerby | 52/467 X |
| 4,075,811 | 2/1978 | Keith | 52/465 X |

FOREIGN PATENT DOCUMENTS

| | | | |
|---|---|---|---|
| 180385 | 12/1954 | Austria | 52/465 |
| 1146249 | 5/1957 | France | 52/465 |

*Primary Examiner*—J. Karl Bell

*Attorney, Agent, or Firm*—Harness, Dickey & Pierce

[57] ABSTRACT

A jointing construction for laminated panels of the type having a core lamination of heat insulating material and facing sheet laminations bonded to opposed sides of the core, said joint construction comprising at least one pair of flanges each of which is defined by turning one of a pair of opposed edge portions of one facing sheet outwardly substantially perpendicular to the plane of said sheet, the jointing construction being intended to join a pair of said panels disposed in use such that one flange of one panel is adjacent one flange of the other panel, a joint cap adapted to engage said adjacent flanges, said joint cap including a bridging portion and a pair of spaced side portions each depending from said bridging portion, one side portion of the joint cap being intended to locate adjacent each flange on the side thereof adjacent the inner portion of the panel on which the respective flange is formed, each said side portion being substantially parallel to its adjacent flange, and a water seal fitted between each flange and the adjacent side portion of the joint cap.

9 Claims, 1 Drawing Figure

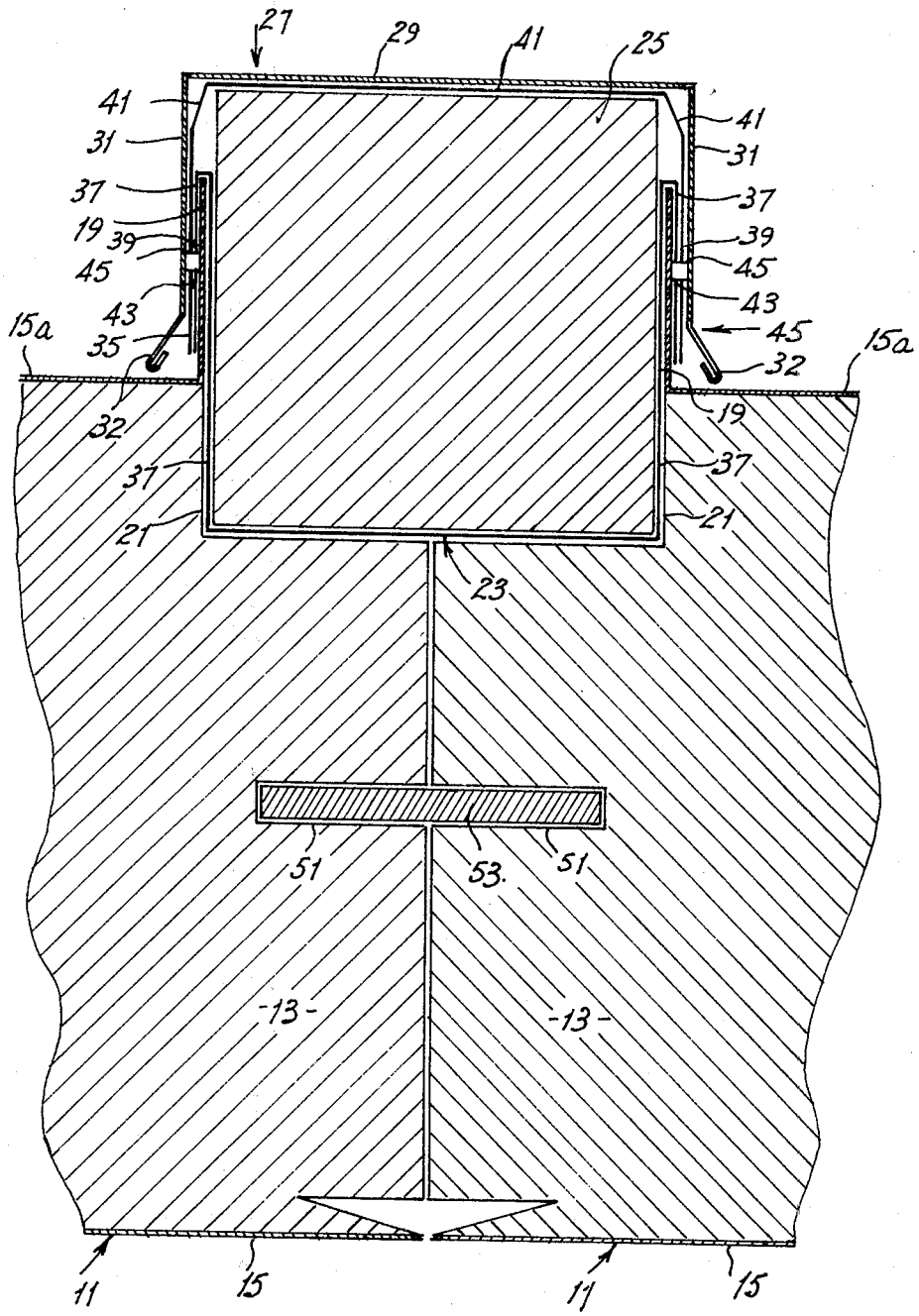
27
29
41
25
41
31
37
19
39
45
43
35
32
15a
41
31
37
39
45
43
45
32
15a
19
37
21
37
21
23
51
53
51
13
13
11
15
11
15

JOINTING CONSTRUCTION

This invention relates to jointing of laminated panels of the type having a core of heat insulating material and facing sheets bonded to opposed sides of the core.

Conventional jointing of laminated panels of the type having a core of heat insulating material and facing sheets bonded to opposed sides of the core generally consists of an extrusion of suitable cross-sectional shape engaged between a pair of adjacent panels with a seal formed from non-skinning mastic applied between the extrusion and each panel. The non-skinning mastic is able to provide an effective barrier against moisture laden vapour but is unable to permanently resist penetration by water in situations where water is in contact with the joint for any length of time. Thus, in a building construction, such conventional jointing may be satisfactory between panels forming the walls of the building, however, a roof formed by the panels would be required to be protected by a weather shield or separate waterproof roof so as to prevent water collecting on the roof formed by the panels and subsequently penetrating the conventional joints.

It is an object of this invention to provide a water proof jointing for panels of the type having a core of heat insulating material and facing sheets bonded to opposed sides of the core.

In one form the invention resides in a jointing construction for laminated panels of the type having a core lamination of heat insulating material and facing sheet laminations bonded to opposed sides of the core, said joint construction comprising at least one pair of flanges each of which is defined by turning one of a pair of opposed edge portions of one facing sheet outwardly substantially perpendicular to the plane of said sheet, the jointing construction being intended to join a pair of said panels disposed in use such that one flange of one panel is adjacent one flange of the other panel, a joint cap adapted to engage said adjacent flanges, said joint cap including a bridging portion and a pair of spaced side portions each depending from said bridging portion, one side portion of the joint cap being intended to locate adjacent each flange on the side thereof adjacent the inner portion of the panel on which the respective flange is formed, each said side portion being substantially parallel to its adjacent flange, and a water seal fitted between each flange and the adjacent side portion of the joint cap.

The invention will be better understood by reference to the following description of one specific embodiment thereof as shown in the accompanying drawing which is a schematic cross-sectional view of a joint according to the invention.

As shown in the drawing the laminated panels 11 are composed of a core lamination 13 of expanded polystyrene insulation and a facing sheet lamination 15 bonded by structural thermosetting adhesive to each side of the core 13 such that the panel behaves as a structural unit.

At least one pair of opposed edge portions of one facing sheet 15*a* of each panel are turned outwardly substantially perpendicular to the plane of the sheet 15*a* so as to form a pair of flanges 19. The side 15*a* would, in use, be the weather-exposed side of the panel. The height of the flanges 19 is dependent on the particular application of the panels; thus, if the panels are intended to form a weather-exposed ceiling or roof the height of the flanges would be dependent on the pitch of the roof or ceiling and the intensity of rainfall to be catered for.

A rabbeted edge 21 is formed in the core 13 adjacent each flange 19, the width of each rabbet being equal to the height of its corresponding flange. With two panels disposed adjacent each other in the manner shown in the accompanying drawing, a channel 23 is defined by the aligned rabbeted edges 21 and the respective flanges 19. A plug 25 formed from heat insulating material such as polystyrene is preferably located in the channel 23; the dimensions of the plug being preferably such that it protrudes beyond the outer ends of the adjacent flanges. If however, the joint is not required to have heat insulation properties, the plug may be omitted.

A joint cap 27 is provided to engage the adjacent flanges of the panels being joined. The joint cap includes a bridging portion 29 and a pair of spaced side portions 31 each depending from said bridging portion. Each side portion of the joint cap is adapted to locate adjacent one flange on the side of said flange adjacent the inner portion of the panel on which the flange is formed; thus, as shown in the drawing, each side portion 31 of the joint cap is located adjacent one flange on the side thereof remote from the channel 25. The free end of each side portion of the joint cap is adapted to engage on the particular facing sheet 15*a* of the panel from which its associated flange is formed and is therefore provided with a safety edge 32 so as to prevent damage to the facing sheet.

A water seal 35 is fitted between each flange 19 and the adjacent side portion 31 of the joint cap 27. The seal 35 preferably includes a first membrane 37 formed from suitable flexible plastics material such as polythene. The first membrane extends along the length of the joint and in addition extends across the joint from adjacent the base of each flange such that the inner portion of the membrane is disposed between the channel 23 and the plug 25, and each longitudinal side portion of the membrane is disposed adjacent one of the flanges 19 on the side thereof remote from the channel. A layer of non-drying sealant 39 provides a seal between each longitudinal side portion of the first membrane and the adjacent flange. If the joint between the panels is formed without the plug 25 the inner portion of the membrane simply drapes within the channel 23. A second membrane 41 also formed from suitable flexible plastics material such as polythene extends along the length of the joint. In addition, the second membrane 41 extends across the joint from adjacent the base of each flange on the side of the first membrane remote from the flange; said second membrane passes across the outer end of the plug 25. In applications where the joint is formed without the plug the second membrane would traverse the outer end of the channel 23. A layer of non-drying sealant 43 provides a seal between each longitudinal side portion of the first membrane and the adjacent portion of the second membrane. A further layer of non-drying sealant 45 provides a seal between the second membrane and each side portion 31 of the joint cap 31.

The side portions of the joint cap are secured to the flanges 19 by suitable connecting means such as rivets; the rivets pass through the first and second membranes and the layers of sealant without damage to the water seal.

The abutting faces of the panels are each preferably provided with a groove 51; the grooves of the abutting faces of panels to be joined being intended to be aligned so as to receive a spline 53 for assisting in alignment of the panels prior to formation of the joint.

After the two panels to be joined are positioned and correctly aligned, the joint of the invention is formed by firstly installing the first membrane 37 with the layer 39 of non-drying sealant provided between each flange and the membrane. The plug 25 is then positioned in the channel 23 so that the inner portion of the first membrane lies between said plug and channel. The second membrane 41 is installed in position with the layer 45 of non-drying sealant between it and each longitudinal side portion of the first membrane. The joint cap 27 is next positioned with the layer 45 of non-drying sealant between each side portion 31 of the joint cap and the second membrane. Each side portion 31 of the joint cap is then secured to the adjacent flange by said connecting means each of which is able to penetrate the first and second members and the layers of sealant without damage to the seal.

In situations where panels joined by said jointing construction form the periphery of a roof or ceiling of a building construction, the corresponding outer or exposed end of each joint is fitted with an end joint cap which encloses the exposed end. The corresponding outer ends of the first and second membranes 37 and 41 respectively are folded and sealed with non-drying sealant prior to fitting of the end cap so as to prevent ingress of water into the joint. The end joint cap preferably underlays the adjacent end portion of the joint cap and is secured to the flanges 19 incorporated in the joint by connecting means such as rivets.

The effectiveness of a joint constructed according to the invention results from the joint being raised above the weather exposed facing sheets of the panels being connected by said joint, thus localised trapping of water in, and hence prolonged contact of water with, the joint is prevented.

The joint construction may be used to provide longitudinal and/or transverse joints between rectangular panels of the type described.

It should be noted that the jointing construction of the invention is not intended to provide a structural joint between panels of the type described but rather a water-proof joint.

I claim:

1. A jointing construction for laminated panels of the type having a core lamination of heat insulating material and facing sheet laminations bonded to opposed sides of the core, said joint construction comprising at least one pair of flanges each of which is defined by turning one of a pair of opposed edge portions of one facing sheet outwardly substantially perpendicular to the plane of said sheet, the jointing construction being intended to join a pair of said panels disposed in use such that one flange of one panel is adjacent one flange of the other panel, a joint cap engaging said adjacent flanges, said joint cap including a bridging portion extending between said flanges and a pair of spaced side portions each depending from said bridging portion, one side portion of the joint cap being disposed adjacent each flange on the side thereof opposite to the adjacent panel, each said side portion being substantially parallel to its adjacent flange, and a water seal fitted between each flange and the adjacent side portion of the joint cap, said water seal comprising membrane means extending between the adjacent surfaces of each of said flanges and the respective side portions and across the area between said flanges and sealing means providing a seal between each of said flanges and said side portions and said membrane means.

2. A jointing construction as claimed in claim 1 wherein a rabbeted edge is formed in the core lamination adjacent each flange, the aligned rabbeted edges of said pair of panels in combination with said adjacent flanges forming a channel.

3. A jointing construction as claimed in claim 2 wherein a plug formed of heat insulating material is located in said channel.

4. A jointing construction as claimed in claim 3 wherein the plug is dimensioned so as to protrude beyond the outer ends of the adjacent flanges.

5. A jointing construction as claimed in claim 4 wherein said membrane means includes a first membrane extending along the length of the joint, said first membrane in addition extending across said joint from adjacent the base of each flange on the side thereof remote from said channel, the inner portion of said first membrane being disposed between the channel and the plug and each longitudinal side portion of the membrane being disposed adjacent one of said flanges, a second membrane extending along the length of said joint, said second membrane in addition extending across the joint from adjacent the base of each flange on the side of said first membrane remote from the flange, said second membrane passing across said protruding end of of the plug, the sealing means comprising a layer of non-drying sealant providing a seal between each longitudinal side portion of the first membrane and the adjacent flange, a layer of non-drying sealant providing a seal between each longitudinal side portion of said first membrane and an adjacent portion of said second membrane, and a further layer of non-drying sealant providing a seal between said second membrane and each side portion of the joint cap.

6. A joint construction as claimed in claim 2 wherein said membrane includes a first membrane extending along the length of the joint, said first membrane in addition extending across the joint from adjacent the base of each flange on the side thereof remote from said channel, the inner portion of said first membrane being disposed within said channel and each longitudinal side portion of the membrane being disposed adjacent one of said flanges, a second membrane extending along the length of said joint, said second membrane in addition extending across the joint from adjacent the base of each flange on the side of said first membrane remote from the flange, said second membrane traversing the outer end of said channel, the sealing means comprising a layer of non-drying sealant providing a seal between each longitudinal side portion of the first membrane and the adjacent flange, a layer of non-drying sealant providing a seal between each longitudinal side portion of said first membrane and an adjacent portion of said second membrane, and a further layer of non-drying sealant providing a seal between said second membrane and each side portion of the joint cap.

7. A jointing construction as claimed in claim 5 wherein each side portion of the joint cap is secured to its respective flange by connecting means, said connecting means passing through said first membrane, said second membrane and said layers of sealant.

8. A jointing construction as claimed in claim 6 wherein each side portion of the joint cap is secured to its respective flange by connecting means, said connecting means passing through said first membrane, said second membrane and said layers of sealant.

9. A jointing construction as claimed in claim 1 wherein the free end of each side portion of the joint cap is adapted to engage on the particular facing sheet of the panel from which its associated flange is formed, each said free end being provided with a safety edge.

* * * * *